US011712595B2

(12) United States Patent
Young

(10) Patent No.: US 11,712,595 B2
(45) Date of Patent: Aug. 1, 2023

(54) LOCKING BARBELL PLATE

(71) Applicant: Joshua Young, Longview, WA (US)

(72) Inventor: Joshua Young, Longview, WA (US)

( * ) Notice: Subject to any disclaimer, the term of this patent is extended or adjusted under 35 U.S.C. 154(b) by 0 days.

(21) Appl. No.: 17/320,147

(22) Filed: May 13, 2021

(65) Prior Publication Data

US 2022/0362617 A1 Nov. 17, 2022

(51) Int. Cl.
*A63B 21/072* (2006.01)

(52) U.S. Cl.
CPC ..... *A63B 21/0728* (2013.01); *A63B 21/0724* (2013.01)

(58) Field of Classification Search
CPC ... A63B 21/06; A63B 21/072; A63B 21/0722; A63B 21/0724; A63B 21/0726; A63B 21/0728; A63B 21/075; A63B 21/078; A63B 21/0783
See application file for complete search history.

(56) References Cited

U.S. PATENT DOCUMENTS

| | | | | |
|---|---|---|---|---|
| 4,453,710 | A | 6/1984 | Plotz | |
| 5,911,651 | A | 6/1999 | Liu | |
| 6,971,974 | B2 | 12/2005 | Bowman et al. | |
| 7,588,520 | B2 | 9/2009 | Nalley | |
| 9,138,610 | B2 | 9/2015 | Lovegrove et al. | |
| 9,381,392 | B2 * | 7/2016 | Behle | A63B 21/0728 |
| 9,555,281 | B2 * | 1/2017 | Beckman | A63B 21/0726 |
| 9,776,032 | B2 | 10/2017 | Moran et al. | |
| 9,925,407 | B2 * | 3/2018 | Davies, III | A63B 21/15 |
| 10,195,477 | B2 | 2/2019 | Marjama et al. | |
| 2014/0162855 | A1 * | 6/2014 | Beckman | A63B 21/075 482/139 |
| 2015/0231441 | A1 * | 8/2015 | Davies, III | A63B 21/0728 482/107 |

* cited by examiner

*Primary Examiner* — Loan B Jimenez
*Assistant Examiner* — Zachary T Moore
(74) *Attorney, Agent, or Firm* — Kolisch Hartwell, P.C.

(57) ABSTRACT

A weight plate may be provided with an inner face configured for mounting on the outer surface of a bar and a securing mechanism arranged adjacent the inner face for selectively securing and unsecuring the weight plate relative to the bar. The securing mechanism may be capable of being locked in a secured condition with the weight plate secured to the bar and being locked in an unsecured condition with the weight plate unsecured from the bar. A control apparatus for the securing mechanism may be operable to switch the securing mechanism between the secured and unsecured conditions, and may include a trigger operable, with the securing mechanism in the unsecured condition, to switch the securing mechanism to be locked in the secured condition, and a handle operable, with the securing mechanism in the secured condition to switch the securing mechanism to be locked in the unsecured condition.

12 Claims, 10 Drawing Sheets

SECTION B-B

LOCKING BARBELL PLATE

FIELD OF THE DISCLOSURE

The field of the present disclosure includes exercise equipment, in particular weights for use with a barbell or dumbbell. More specifically, the weights are in the form of plates that mount on a sleeve of the barbell or dumbbell and are secured onto the sleeve without a requirement for a collar.

BACKGROUND OF THE DISCLOSURE

Prior plates for weightlifting each included a cylindrical hole for mounting on each of the pair of cylindrical sleeves of a barbell or dumbbell where the hole is machined to a size for a sliding fit on each sleeve. The barbell or dumbbell is typically used only with such plates equally distributed on each of the pair of sleeves and with a collar mounted on each sleeve with the collar's fastening feature engaged to ensure that the plates do not move along the sleeve during use. If a barbell or dumbbell is used with sliding-fit plates that are not held in place, the user risks the plates moving along the sleeve or falling off, which may result in damage or injury.

Other plates have a built-in mechanism for attaching to a cylindrical sleeve, for example the mechanism described in the published patent application: US20140162855. This publication describes plates with a self-contained clipping system to attach to a bar sleeve. However, as described and depicted in the FIGS. 1-4 embodiments of the '855 publications, the plates, in attaching, require movement to a misaligned configuration. Such a configuration, with the weight not evenly distributed about the axis of the sleeve is generally not useful for many types of exercise use.

Weight plates described in other patents include a built-in mechanism for attaching to a sleeve or for attaching to other plates but have drawbacks in operation that have prevented such plates from entering into common use with standard cylindrical sleeves. These patents are: U.S. Ser. No. 10/195,477, U.S. Pat. Nos. 9,925,407, 9,776,032, 9,381,392, 9,138,610, 7,588,520, 6,971,974, 5,911,651, and 4,453,710. The disclosures of these and all other publications referenced herein are incorporated by reference in their entirety for all purposes.

The present disclosure recognizes a need for a built-in securing mechanism with readily operable trigger and release mechanisms that reliably secure the plate on the sleeve when mounted for exercise use and allow the plates to be installed and removed with simple movements.

SUMMARY OF THE DISCLOSURE

The subject matter disclosed herein relates to a weight plate for mounting on a bar providing a substantially cylindrical outer surface. The weight plate may include a substantially cylindrical inner face configured for mounting on the substantially cylindrical outer surface of the bar. The weight plate may also include a securing mechanism arranged adjacent the inner face for selectively securing and unsecuring the weight plate relative to the bar. The securing mechanism may be capable of being locked in a secured condition with the weight plate secured to the bar and capable of being locked in an unsecured condition with the weight plate unsecured from the bar. The weight plate may include a control apparatus for the securing mechanism operable to switch the securing mechanism between the secured and unsecured conditions. The control apparatus may include a trigger operable, with the securing mechanism in the unsecured condition, to switch the securing mechanism to be locked in the secured condition. The control apparatus may further include a handle operable, with the securing mechanism in the secured condition to switch the securing mechanism to be locked in the unsecured condition.

Another exemplary embodiment provides a central portion for a weight plate for use in mounting on a bar providing a substantially cylindrical outer surface. The central portion of the weight plate may be configured for coupling to an outer disk of selectable weight. The central portion of the weight plate may include a substantially cylindrical inner face configured for mounting on the substantially cylindrical outer surface of the bar. The central portion of the weight plate may also include a securing mechanism arranged adjacent the inner face for selectively securing and unsecuring the central portion of the weight plate relative to the bar. The securing mechanism may be capable of being locked in a secured condition with the central portion of the weight plate secured to the bar and capable of being locked in an unsecured condition with the central portion of the weight plate unsecured from the bar. The central portion of the weight plate may further include a control apparatus for the securing mechanism operable to switch the securing mechanism between the secured and unsecured conditions. The control apparatus may include a trigger operable, with the securing mechanism in the unsecured condition, to switch the securing mechanism to the secured condition. The control apparatus may further include a handle operable, with the securing mechanism in the secured condition to switch the securing mechanism to the unsecured condition.

Yet another embodiment provides a weight plate system with a plurality of weight plates with each weight plate having a selectable total weight. Each weight plate may include an automatic securing mechanism. The weight plates may be used by mounting on a bar that has a substantially cylindrical outer surface. Each weight plate may include a central portion and an outer disk of selectable weight coupled to the central portion. The central portion may include a substantially cylindrical inner face configured for mounting on the substantially cylindrical outer surface of the bar. The central portion may further include a securing mechanism arranged adjacent the inner face for selectively securing and unsecuring the central portion of the weight plate relative to the bar. The securing mechanism may be capable of being locked in a secured condition with the central portion of the weight plate secured to the bar and capable of being locked in an unsecured condition with the central portion of the weight plate unsecured from the bar. The central portion may further include a control apparatus for the securing mechanism operable to switch the securing mechanism between the secured and unsecured conditions. The control apparatus may include a trigger operable, with the securing mechanism in the unsecured condition, to switch the securing mechanism to the secured condition. The control apparatus may further include a handle operable, with the securing mechanism in the secured condition to switch the securing mechanism to the unsecured condition.

Features, functions, and advantages may be achieved independently in various embodiments of the present disclosure, or may be combined in yet other embodiments, further details of which can be seen with reference to the following description and drawings. Advantages of the present disclosure will be more readily understood after considering the drawings and the Detailed Description.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION OF THE DISCLOSURE

Examples of a weight plate with an improved operation for switching between secured and unsecured conditions on a sleeve of a barbell or a dumbbell are shown in FIGS. 1-25. Unless otherwise specified, a weight plate, a portion of a weight plate, or a weight plate set, in accordance with the present disclosure may, but is not required to, contain at least one of the structures, components, functionalities, and/or variations described, illustrated, and/or incorporated herein.

Figure 1:
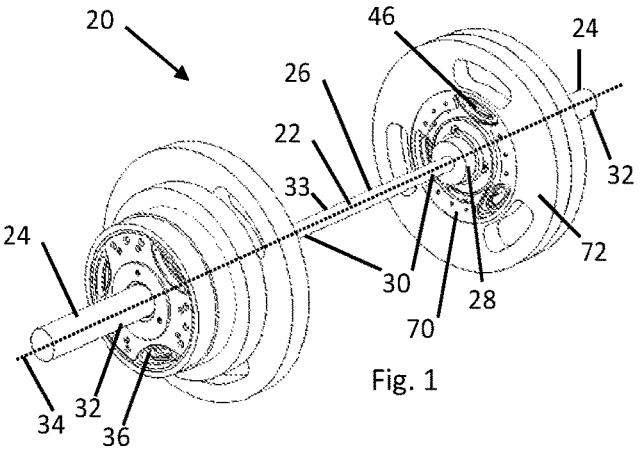
FIG. 1 is a pictorial view of a barbell with weights embodying the present disclosure mounted on each of a pair of sleeves.

As shown in FIG. 1, a weightlifting set, indicated generally at 20, may include a bar 22 configured for use in exercising. Bar 22 may provide a pair of mounting surfaces for receiving and supporting plates, for example, substantially cylindrical outer surfaces 24, or any other suitable configuration for mounting surfaces. Bar 22 is represented in the figures as a barbell that is ordinarily for lifting with two hands, and may alternatively be a dumbbell for lifting with one hand, or any other configuration suitable for use in exercising. The embodiments for plates described herein may be used with existing styles of barbells and dumbbells and may be adapted for use on any style of barbell or dumbbell.

One existing style for a barbell or dumbbell typically includes a handgrip portion 26 between two annular stops 28, one at each of first and second ends 30 of handgrip portion 26 of bar 22. Outer surfaces 24 may be provided by sleeves 32 that may be rotatable relative to handgrip portion 26 about a longitudinal axis 34 of bar 22. Bar 22 may include a central core 33 and typically the sleeves are rotatably coupled to central core 33. Alternatively, the handgrip portion may include a sleeve that is rotatable relative to the central core.

Figure 2:
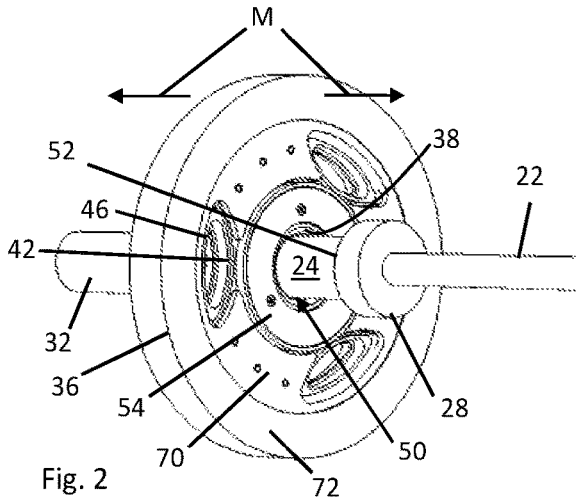
FIG. 2 is a pictorial view of one of the weights being moved along one of the sleeves of the barbell.

As best seen in FIGS. 1-5, weight plate 36 for mounting on bar 22 on outer surface 24 may include an inner face 38 configured for cooperation with outer surface 24, for example a substantially cylindrical inner face may be configured for mounting on substantially cylindrical outer surface 24 of bar 22. Weight plate 36 may include a securing mechanism 40 arranged adjacent inner face 38 for selectively securing and unsecuring weight plate 36 relative to bar 22. As will be described below, securing mechanism 40 may be capable of being locked in a secured condition (see, e.g., FIGS. 7*c* and 9) with weight plate 36 secured to bar 22 and substantially immobile relative to sleeve 32. Securing mechanism 40 may be capable of being locked in an unsecured condition (see FIGS. 7*b* and 8) with weight plate 36 unsecured from bar 22, and generally movable along sleeve 32 as illustrated in FIG. 2 by arrows M.

As may be seen in FIGS. 6-13, securing mechanism 40 may include a control apparatus 42 that is operable to switch securing mechanism 40 between the secured and unsecured conditions. Control apparatus 42 may include a trigger 44 (FIG. 11) operable, with the securing mechanism in the unsecured condition, to switch the securing mechanism to be locked in the secured condition. Control apparatus 42 may include a handle 46 operable, with the securing mechanism in the secured condition, to switch the securing mechanism to the unsecured condition, and typically to be locked in the unsecured condition.

Securing mechanism 40 typically includes one or more brake shoes 48, such as three brake shoes, which may be arranged symmetrically around inner face 38 of plate 36. Brake shoes 48 may be movable relative to inner face 38, for example in a symmetrical fashion, to narrow the effective inner diameter of inner face 38 of weight plate 36 to secure the plate to the sleeve of the bar. Alternatively, a single brake shoe may be used, which may be movable relative to inner face 38, or one or more of multiple brake shoes may be movable while one or more others are immobile. In any of these alternatives, at least one brake shoe is movable to decrease the effective inner diameter of inner face 38 to secure the plate to the sleeve.

Typically, brake shoes 48 in the unsecured condition are in a retracted position (FIGS. 7*b* and 8) within inner face 38, or at least in a position relative to inner face 38 that does not prevent movement of plate 36 along sleeve 32. Brake shoes 48 in the secured condition are typically in an extended position that is within inner face 38 (FIGS. 7*c* and 9) sufficiently far enough to prevent movement of plate 36 along sleeve 32. For example, as shown in FIG. 7*b* in the unsecured condition, brake shoes 48 are at or beyond (or outside) inner face 38 and do not reduce the effective inner diameter of inner face 38. In the secured condition shown in FIG. 7*c*, the effective inner diameter $D_{SC}$ of inner face 38 is reduced to a smaller diameter configured to secure weight plate 36 on outer surface 24 of bar 22.

Figure 7B:
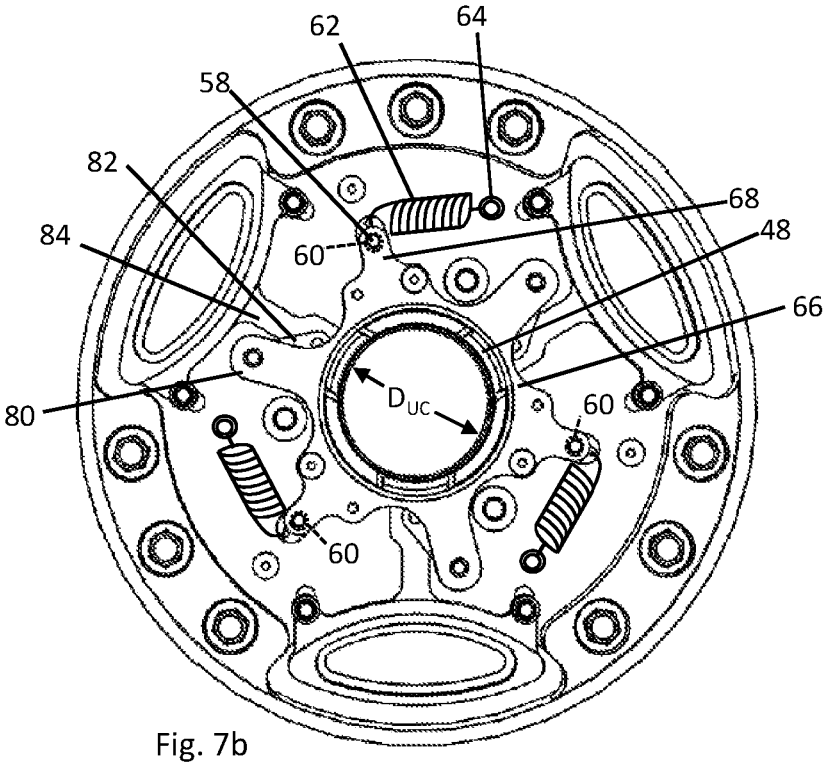
FIGS. 7*b* and 7*c* are cross-sectional views similar to that of FIGS. 7 and 7*a*, showing the securing mechanism in the unsecured condition (FIG. 7*b*) and the secured condition (FIG. 7*c*), and both showing in phantom line the location of a notch that holds the locking pin in the unsecured condition.
Figure 7C:
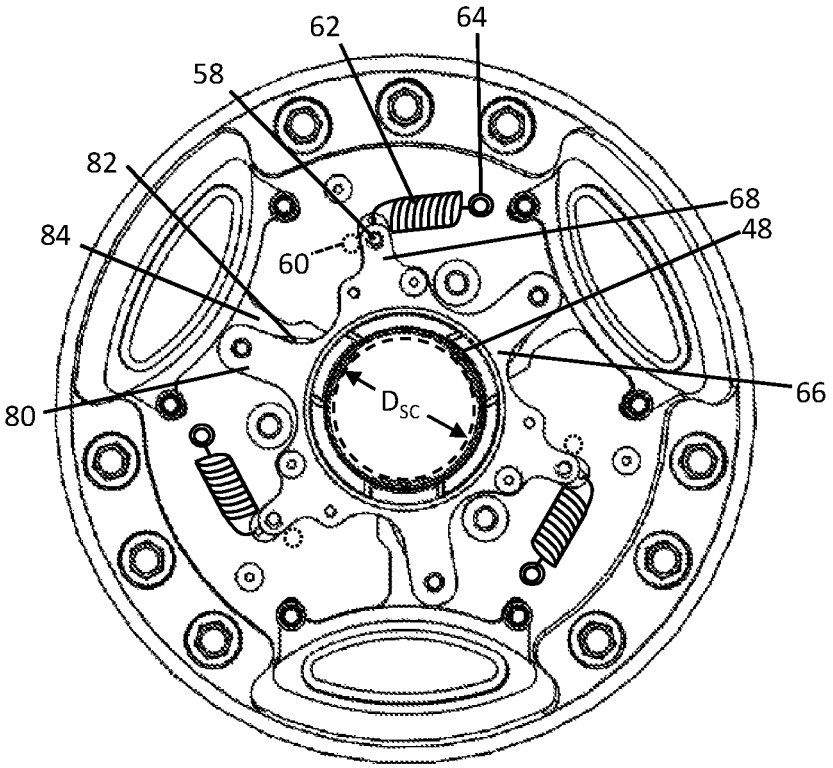
Figure 8:
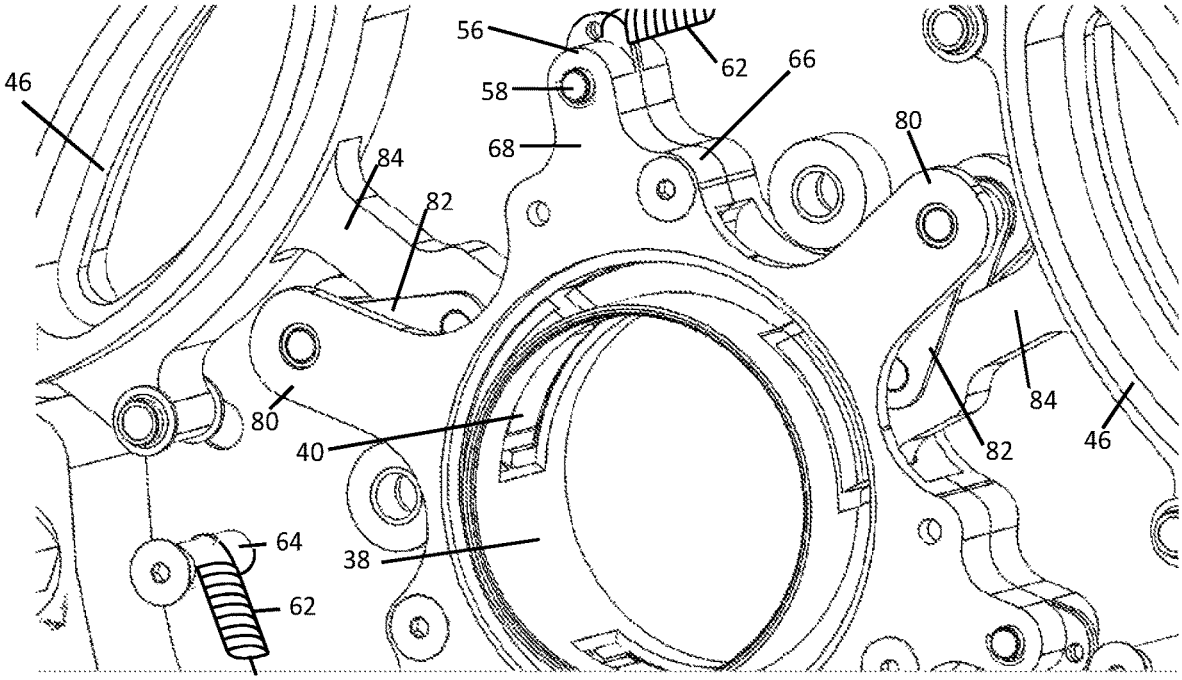
FIG. 8 is an expanded pictorial view of the cam and the shoes in the unsecured condition.
Figure 9:
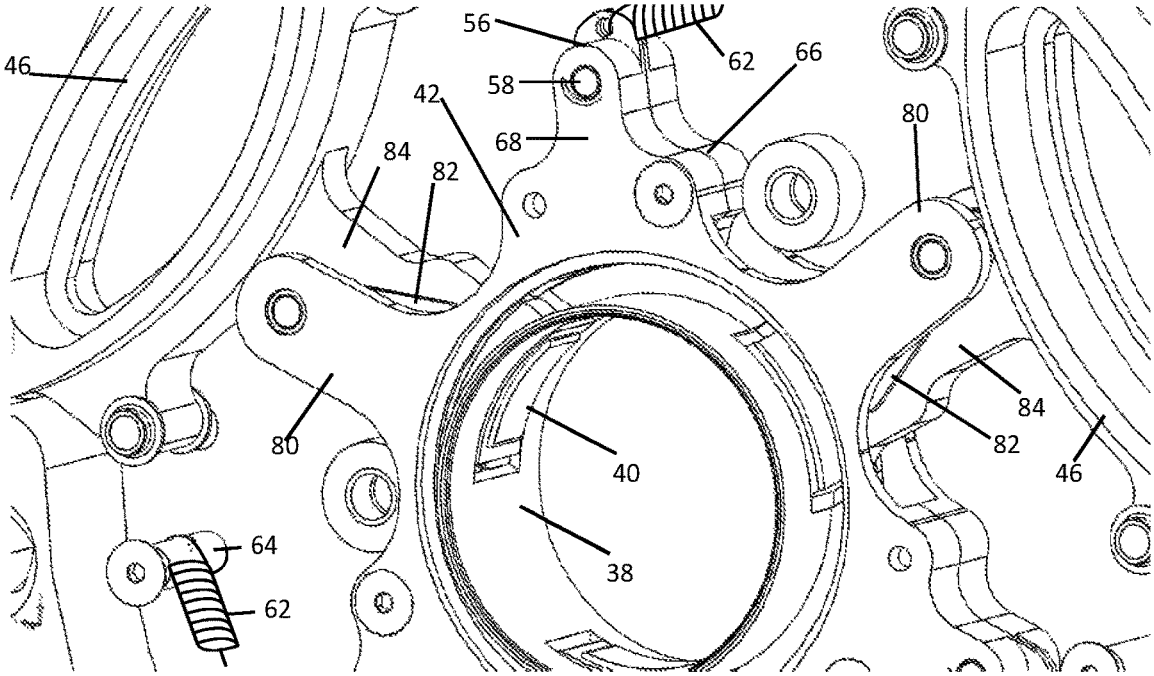
FIG. 9 is an expanded pictorial view of the cam and the shoes in the secured condition.
Figure 10:
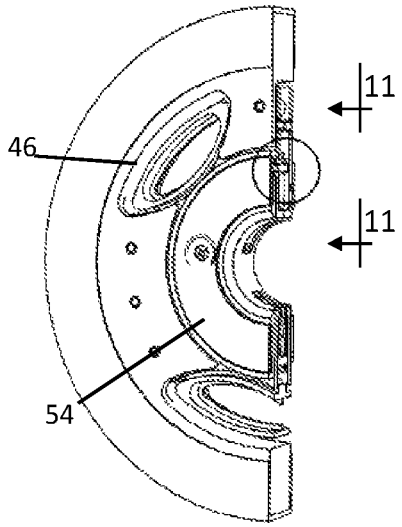
FIG. 10 is a cross-sectional view showing the location of the trigger for moving the shoes to the secured condition, and a ring that, when pressed against the base on the sleeve of the barbell, activates the trigger.

As shown in FIGS. 8 and 9, the brake shoes' being at or beyond (or outside) inner face 28 means the brake shoes are withdrawn in a direction away from sleeve surface 24 and the brake shoes' being within inner face 28 means the brake shoes are extended in a direction towards sleeve surface 24 into a small gap 50 between inner face 28 and sleeve 32. Gap 50 typically allows movement M of plate 36 on sleeve 32 in the unsecured condition as indicated in FIG. 2 by arrows M and as shown by the effective inner diameter $D_{UC}$ in FIG. 7*b*. In the secured condition brake shoes 48 reduce the effective inner diameter to $D_{SC}$ as best seen in FIG. 7*c*.

Control apparatus 42 may include one handle for each brake shoe, for example, three handles, one for each of three brake shoes as illustrated in the drawings, or a single handle may be provided. In the case of the single handle with multiple movable brake shoes, the handle may be operable to move all of the brake shoes. In the case of multiple handles, each of the handles is typically operable to move all of the movable brake shoes. In any case, at least one handle 46 is typically coupled to the one or more brake shoes, and the handle is operable to move at least one brake shoe from the securing position within the inner face to the unsecured position at or beyond the inner face.

As seen, e.g. in FIG. 2, each annular stop 28 on each end of bar 22 may provide a base 52 adjacent to, and inboard of, substantially cylindrical outer surface 24 of sleeve 32. In operation, weight plate 36 may be mounted on (and removed from) sleeve 32, typically with the securing mechanism in the unsecured condition, by sliding plate 36 along outer surface 24 of bar 22. In the mounting direction, plate 36 may be moved into contact with base 52 in order to switch the securing mechanism to the secured condition, typically to be locked in the secured condition. In the case of one or more additional plates mounted outside the first plate, each plate may be switched to the secured condition by contact with the adjacent plate.

Figure 3:
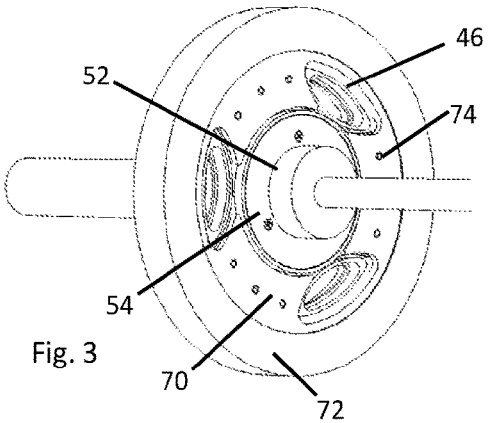
FIG. 3 is a pictorial view of the weight fully mounted on the sleeve, abutting an annular base of the sleeve of the barbell.
Figure 4:
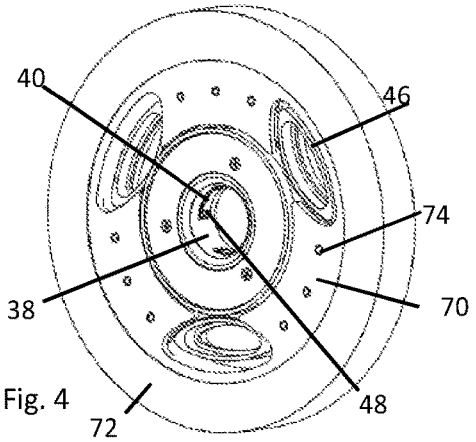
FIG. 4 is a pictorial view of the weight showing a set of clamping shoes within an inner face of a center hole of the weight, the weight shown from a first side, and also showing a central portion bolted to an outer portion.
Figure 5:
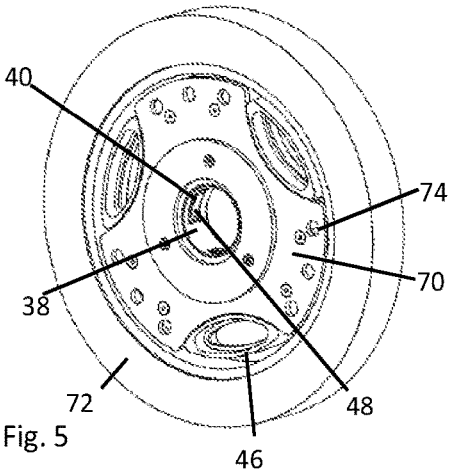
FIG. 5 is a pictorial view of the weight showing the set of clamping shoes within the inner face of the center hole of the weight, the weight shown from the opposite side as compared to FIG. 4, and also showing both the central portion and the outer portion.
Figure 11:
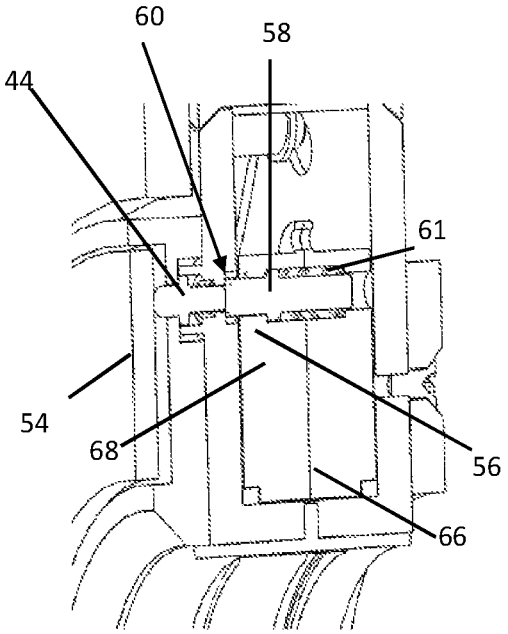
FIG. 11 is an expanded cross-sectional view of the trigger for moving the shoes to the secured condition and the ring that activates the trigger, as well as a locking pin that is moved by activation of the trigger.
Figure 12:
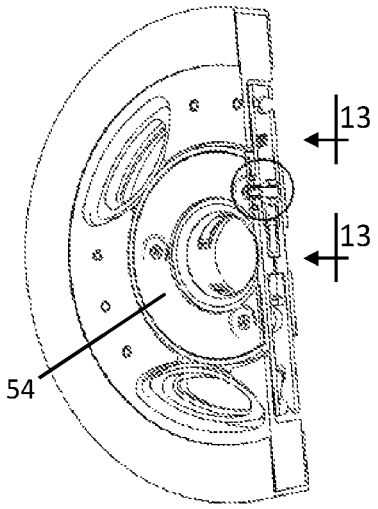
FIG. 12 is a cross-sectional view showing the ring that activates the trigger and one of several posts for holding the ring and aligning its movement.
Figure 13:
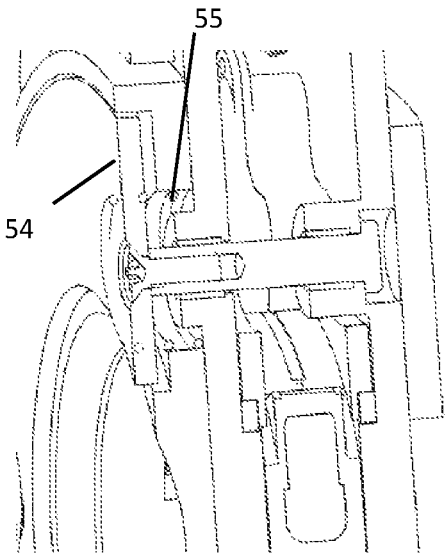
FIG. 13 is an expanded cross-sectional view of the ring that activates the trigger, and also showing a spring biasing the ring to a position where it does not activate the trigger.
Figure 14:
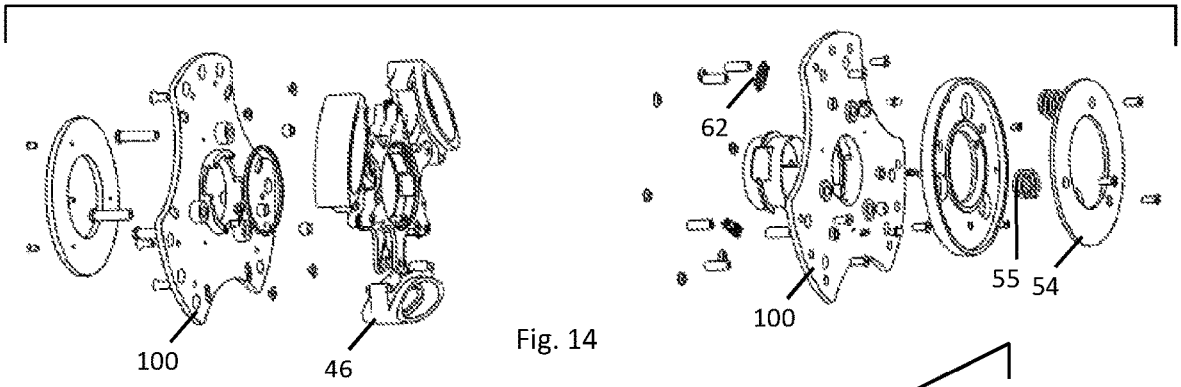
FIG. 14 is an exploded pictorial view of the central portion of the weight of FIG. 6, showing the handles, brake shoes, cam, two rings, a cylindrical member that provides the inner face of the center hole of the central portion of the weight, and two panels with cylindrical portions that together provide a bearing surface on which the cam rotates, along with biasing springs for one of the rings and fastening hardware.
Figure 15:
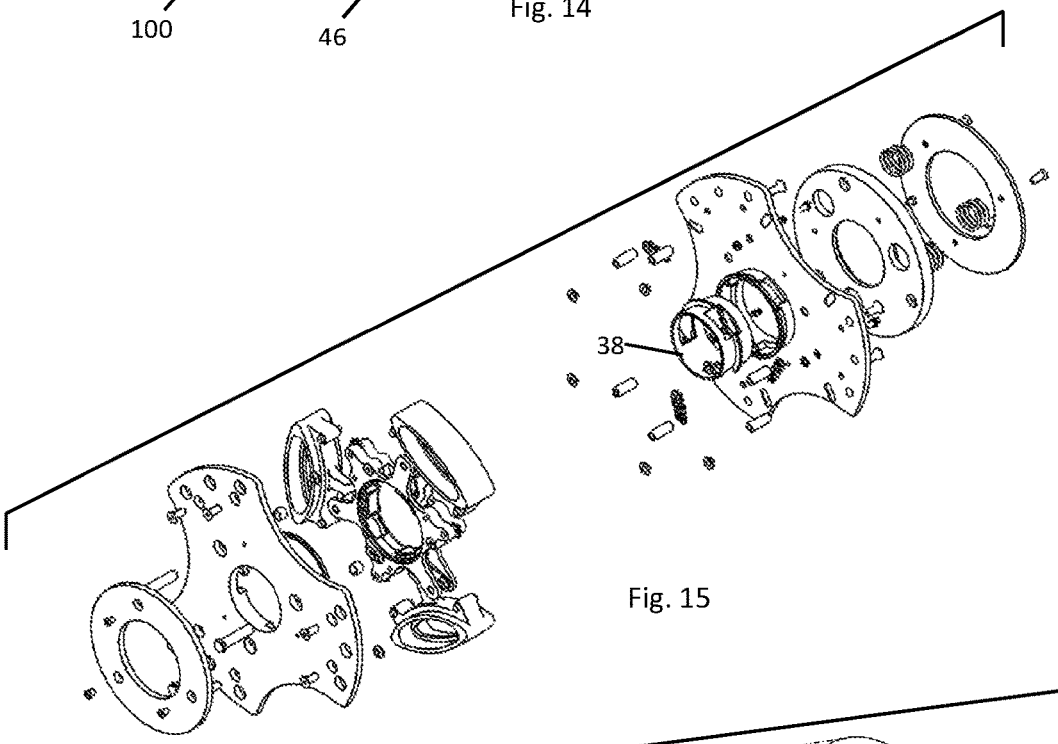
FIG. 15 is an exploded pictorial view of the central portion of the weight viewed from a different angle as compared to FIG. 14.
Figure 16:
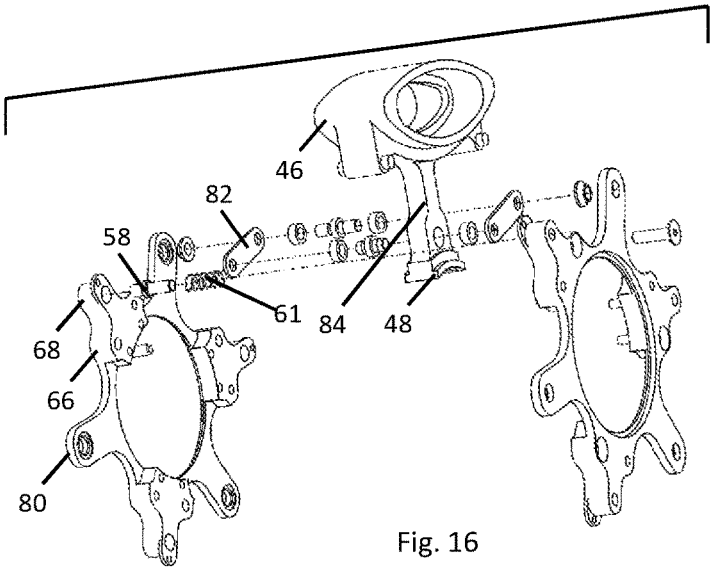
FIG. 16 is an exploded pictorial view of one handle with the associated brake shoe, and the cam, and the interconnections and fastening hardware therebetween, and also showing the locking pin and its biasing spring associated with the handle and brake shoe.

Trigger 44 may include a ring 54, as best seen in FIGS. 2-3 and 11, that is operable to switch securing mechanism 40 to the secured condition when ring 54 contacts and is pressed against base 52 (or an adjacent plate). Plate 36 may be constructed with trigger 44 having only a single ring on one side of plate 36, in which case plate 36 is preferably mounted with the single ring on the inboard side to contact base 52 and trigger the securing mechanism into the secured condition. Alternatively, as will be discussed below for FIGS. 19-25, trigger 44 may include a second ring on an opposite side of plate 36, with each ring configured to switch the securing mechanism to the secured condition when the ring contacts and is pressed against the base irrespective of the orientation of the weight plate. Ring 54 may be biased by a spring 55 to activate trigger 44 only under pressure from, e.g., the base.

Figure 6:
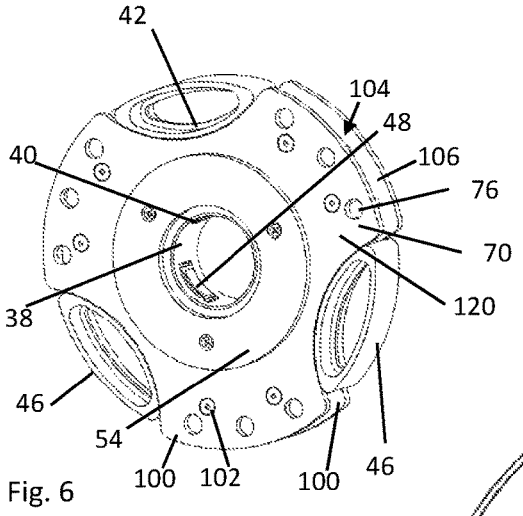
FIG. 6 is a pictorial view of only the central portion of the weight, showing bolt holes where the outer portion would be attached.

As seen in FIGS. 1-5 and 7, weight plate 36 may include a central portion 70 and an outer portion 72 attached to central portion 70 by any suitable fastener, e.g., screws or bolts 74. Central portion 70 may provide securing mechanism 40 and control apparatus 42, including trigger 44, handle(s) 46, and brake shoes 48. Outer portion 72 may provide additional weight and cushioning to weight plate 36 and may be removable, as illustrated by FIG. 6, by removing bolts 74 from a corresponding set of holes 76, which may be threaded, or nuts may be provided, in central portion 70. For example, central portion 70 may include nine bolt holes 76 for receiving bolts 74 to attach outer portion 72 to central portion 70 of weight plate 36.

Outer portion 72 may be provided in different sizes, in weight and diameter, so that the same or substantially same central portion 70 may be used in differently sized weight plates 36. In this manner, a set of outer portions 72 in a variety of sizes and weights, may each be attached to one of a set of standardized central portions 70 and provide a set of weight plates in a range of weights and sizes.

Figure 17:
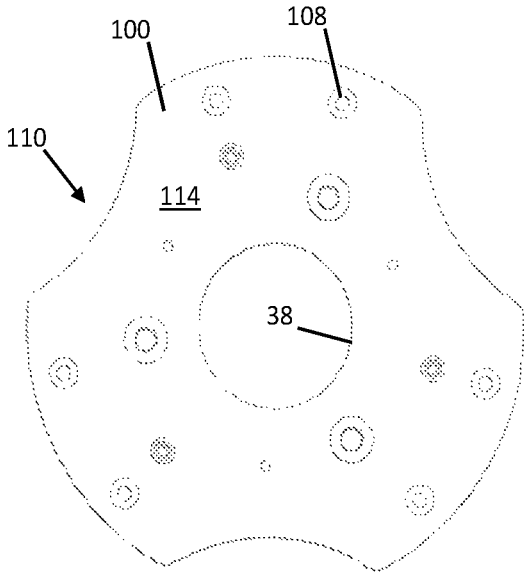
FIG. 17 is a plan view of one of the panels viewed from the outer side.
Figure 18:
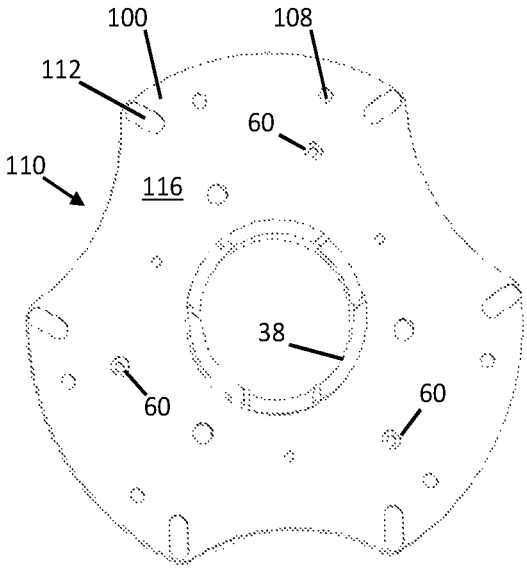
FIG. 18 is a plan view of one of the panels, as in FIG. 17 but viewed from the inner side where the circular bearing surface for the cam can be seen.
Figure 19:
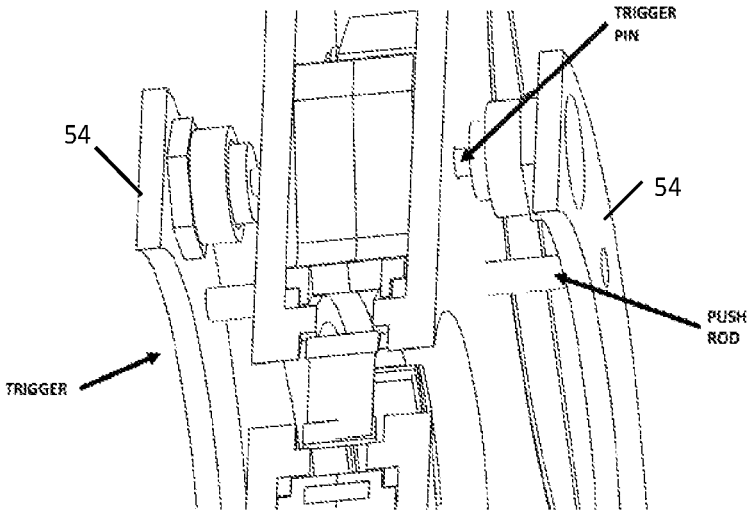
FIG. 19 is a cross-sectional view of an alternative embodiment for the central portion of the weight plate with rings that are operable on each side to trigger the securing mechanism regardless of which direction the plate is installed on the bar.
Figure 20:
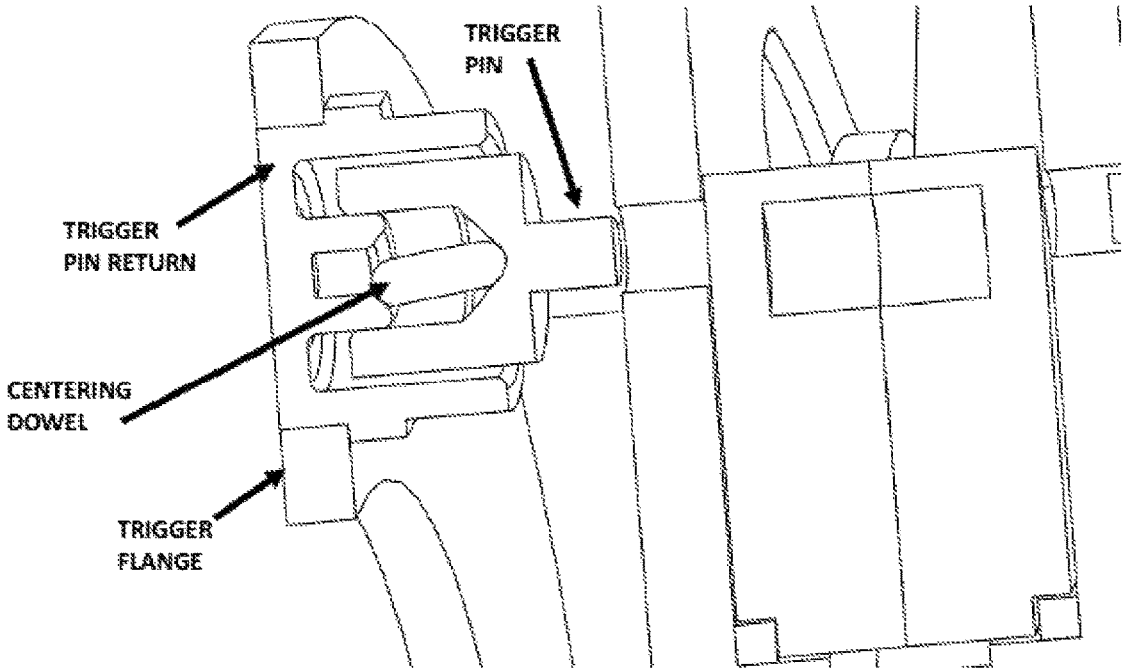
FIG. 20 is a cross-sectional view of the embodiment of FIG. 19, showing detail on the ring and trigger pin on one side of the plate for activating the secured condition.
Figure 21:
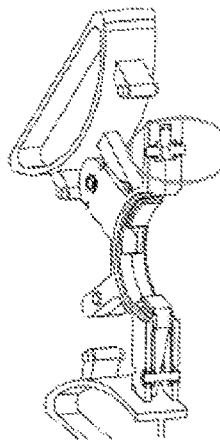
FIG. 21 is a cross-sectional view of the internal structure for the trigger for the embodiment of FIG. 19 for moving the shoes to the secured condition, including linchpins and a preload pin that are controlled by the triggers.
Figure 22:
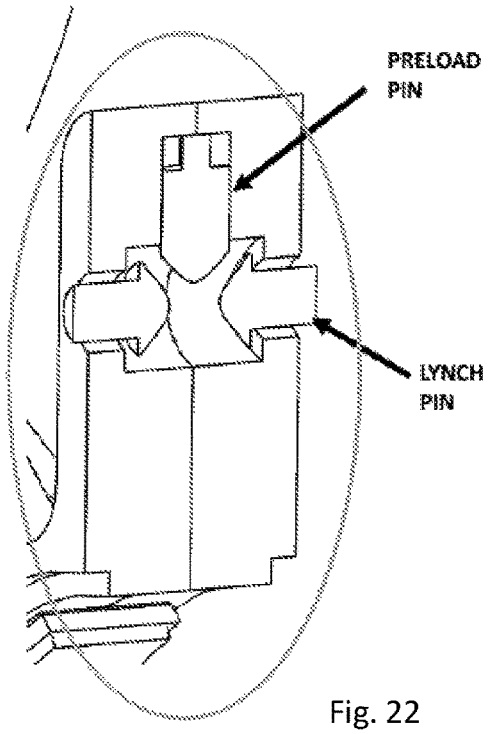
FIG. 22 is an expanded cross-sectional view of FIG. 21, showing in the cam the pair of opposed linchpins, each of which may be activated by the trigger pin on one side of the weight plate, and a preload pin that biases both linchpins to the non-triggered position.
Figure 23:
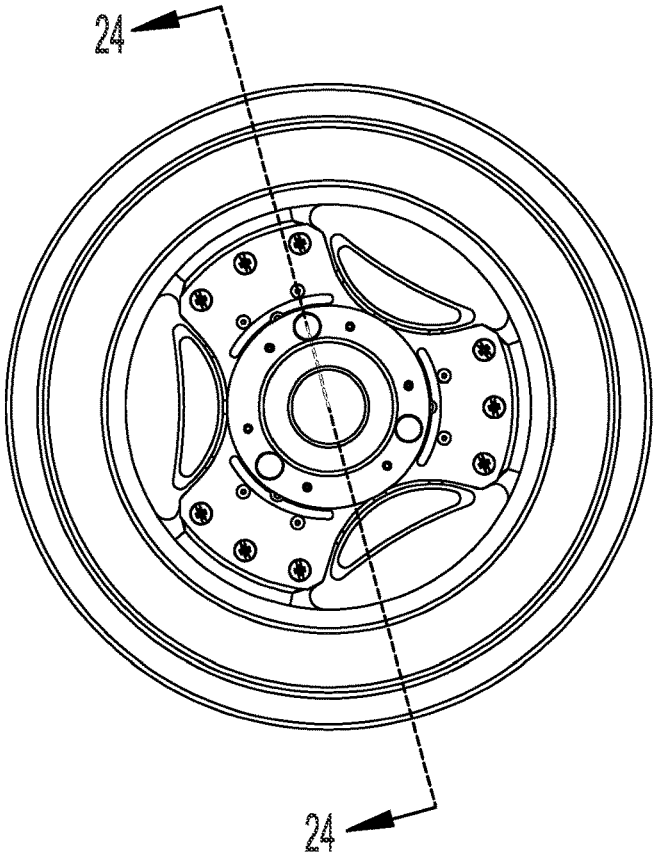
FIG. 23 is a plan view of a weight plate with a dual-sided trigger as in FIGS. 19-22.
Figure 24:
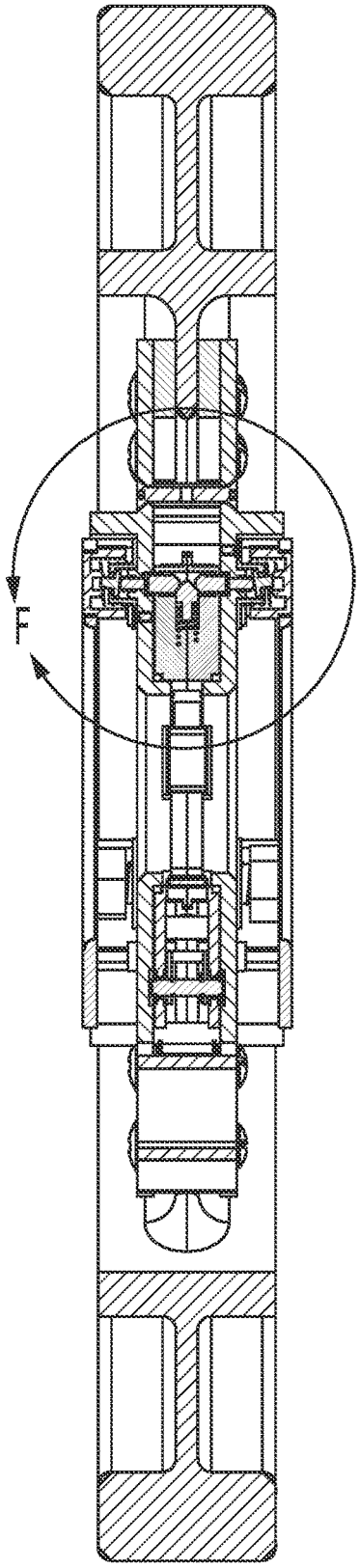
FIG. 24 is a cross-sectional view of the weight plate of FIG. 23, showing a pair of rings, one on each side and each operable to control a trigger for switching the securing mechanism from the unsecured condition to the secured condition.
Figure 25:
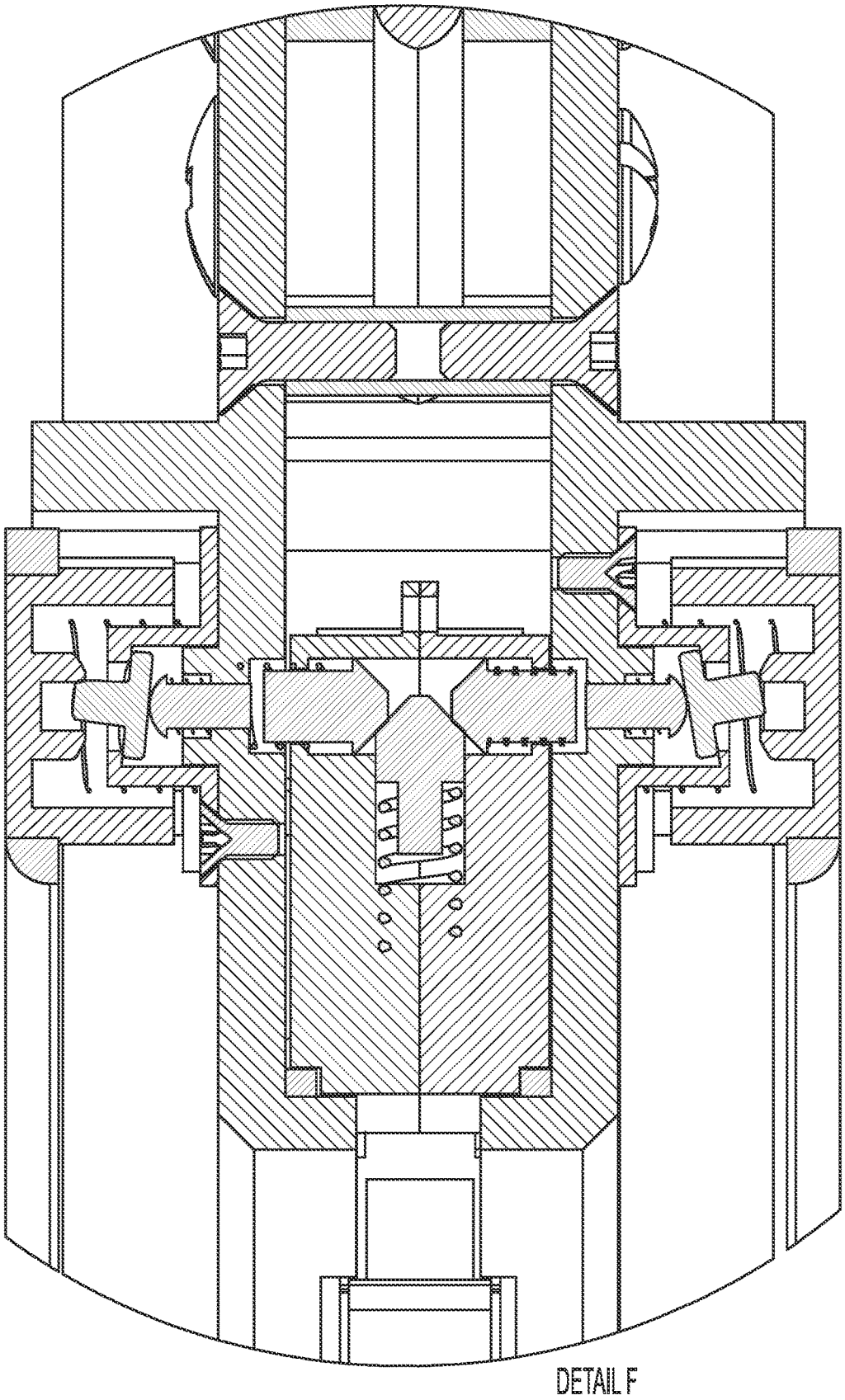
FIG. 25 is an expanded cross-sectional view of the weight plate of FIGS. 23 and 24 showing the pairs of rings, triggers, and linchpins, and the preload pin that biases both linchpins to the non-triggered position.

Central portion 70 may include two opposed panels 100 (see, e.g., FIGS. 6, 17, and 18) coupled together by bolts 102 to form a space 104 in between that may provide a housing 106 for control apparatus 42. Panels 100 may provide support structure and fittings for components of control apparatus 42. As best seen in FIGS. 17 and 18, showing the two sides of panels 100, a set of holes 108 may be provided for bolts 102. Panels 100 may include cutouts 110 for handles 46 and slides 112 providing guides for handles 46. Panels 100 may also provide inner face 38. FIG. 17 shows an outer side 114 of panel 100 and FIG. 18 shows an inner side 116 of panel 100. Inner side 116 may include a cylindrical portion 118 that provides a bearing surface 120, on which a cam 66 may be rotatably mounted. It will be understood that for simplicity in FIGS. 17 and 18 holes 76, for coupling central portion 70 to outer portion 72, are not shown.

As best seen in FIGS. 7-13, control apparatus 42 of securing mechanism 40 may include a locking apparatus 56 operable to lock securing mechanism 40 in each of the secured condition and the unsecured condition. For example, securing mechanism 40 may be locked in the unsecured condition by a locking pin 58 being captured in a notch 60 (FIGS. 7*b*, 10, and 11) and may be locked in the secured condition by a biasing mechanism, such as tension spring 62, anchored at a post 64 and pulling a rotating cam 66 in a securing direction (clockwise in FIG. 7) that pushes brake shoes 48 into the secured condition within the circumference of inner face 38 and into gap 50 for securing contact with bar sleeve 32 (FIGS. 7*c* and 9).

Figure 7:
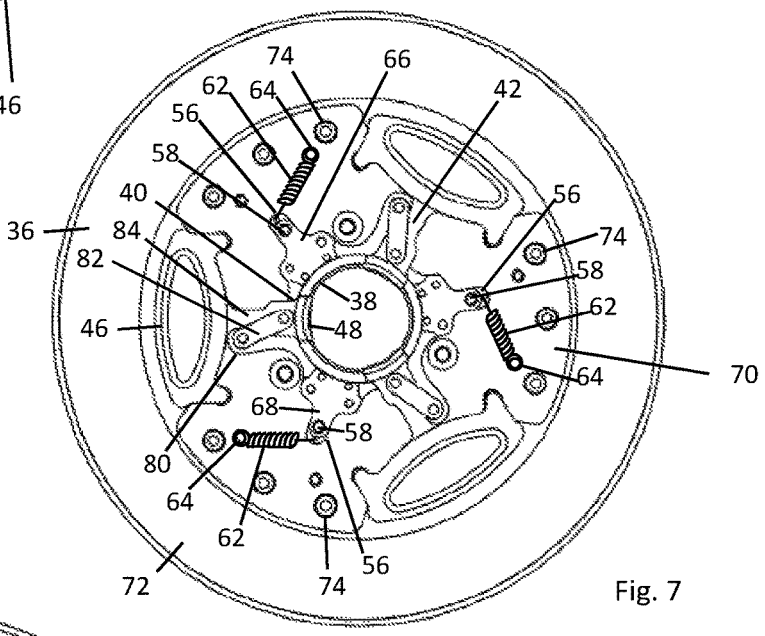
FIG. 7 is a cross-sectional view of the weight showing the connections between the handles and the shoes and the cam that rotates as the shoes move between the secured and unsecured conditions.

As seen in FIG. 7, securing mechanism 40 may include three sets of posts 64 anchoring spring 62 to pull a control arm 68 on rotating cam 66 in the securing direction. In each set, rotating cam 66 may include a lever arm 80 coupled to a pivot arm 82, which may be in turn coupled to a handle arm 84 that may extend between handle 46 and brake shoe 48. Cam 66, when rotated in the securing direction by operation of spring 62, also rotates lever arm 80 in the same direction, which pushes pivot arm 82 to move handle arm 84 toward the center of weight plate 36, i.e., into the secured condition with brake shoes 48 moved within the circumference of inner face 38 for securing contact with bar sleeve 32. Springs 62 may be provided with sufficient tension for locking securing mechanism 40 in the secured condition.

Figure 7A:
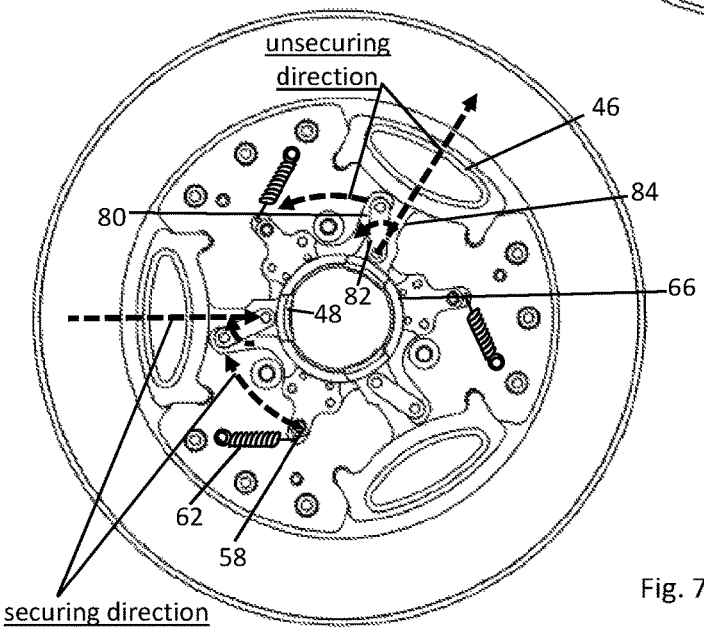
FIG. 7*a* is the same cross-sectional view as in FIG. 7, illustrating the movement of the handles and brake shoes and the rotation of the cam in the securing direction and the unsecuring direction.

FIGS. 7*a*, 7*b*, and 7*c* illustrate movement of components of an embodiment of securing mechanism 40. FIG. 7*a* shows the direction of movements between the unsecured and secured conditions. For example, in the direction from secured to unsecured, i.e., the unsecuring direction, the user pulls handle 46 and its arm 84 radially outward, rotating pivot arm 82 counterclockwise, which in turn rotates cam 66 and each of its lever arms 80 and control arms 68 counterclockwise, which moves brake shoes 48 outside of the inner face and rotates locking pins 58 to notches 60, where bias springs 61 moves locking pins 58 into notches 60 to lock the securing mechanism in the unsecured condition. In the direction from unsecured to secured, i.e., the securing direction, when the trigger is activated to push the locking pins out of the notches, biasing springs 62 pull cam 66 and its lever arms 80 in a clockwise direction, rotating pivot arms 82 clockwise, which in turn pulls the handles and their arms radially inward, causing the brake shoes to move into gap 50 within inner face 38. Biasing springs 62 pulling on cam 66 lock the securing mechanism in the secured condition.

One or both of panels 100 may include a flange 120 that extends outwardly from inner face 38 of weight plate 36. Flange 120 may provide holes 76 or other mechanism for attaching outer portion 72, or otherwise providing support for an outer disk of selectable weight.

A user's picking up weight plate 36 by putting one's fingers through handle 46 and lifting weight plate 36 may by itself move the securing mechanism to the unsecured condition and/or the user can squeeze the handle to move it relative to the rest of the weight plate. This feature may automatically provide for convenient mounting and sliding of plate 36 on sleeve 32 in the unsecured condition. Plate 36 may thus be slid along sleeve 32 until ring 54 contacts either base 52 or another, already-mounted weight plate, triggering the switch to the secured condition.

Weight plate 36 is described in one or more embodiments as having a securing mechanism with three clamps, and may alternatively include one, two, three, or more clamps. Typically the one or more clamps are movable relative to the inner face between a position within the inner face and a position outside the inner face. Where more than one clamp is provided, movement of one of the clamps from the position within the inner face to the position outside the inner face causes movement of the other clamp(s) to the position outside the inner face. Such coordinated movement of two or more clamps may be provided by interconnecting the clamps by the rotating cam.

An alternate embodiment for the triggering mechanism is depicted in FIGS. 19-25 where two rings 54 are provided, each disposed on one side of the weight plate for switching to the secured condition by pressure on ring 54 from either side. This embodiment is otherwise generally the same as the embodiment described for FIGS. 1-18, with the following variations. This configuration may include a trigger pin that is activated by ring 54 through operation of a centering dowel within a trigger pin return. Instead of a locking pin within a control arm of the rotating cam, a pair of opposed linchpins provide for a response to the trigger from either side. The linchpins include conical heads facing one another and a preload pin includes a conical head disposed in between the conical heads of the linchpins. The preload pin may be biased to push the conical heads of the linchpins apart, thus biasing the linchpins toward the locking condition. Activation of either trigger from either side pushes one of the linchpins out of the locked condition in its associated notch, and also backing off the preload pin, which in turn causes the other linchpin to move out of the locked condition in its associated notch. As for the other embodiment, this allows the biasing springs 62 to rotate cam 66 to the secured condition, and springs 62 lock the securing mechanism in the secured condition.

As used herein, the word "exemplary" means "serving as an example, instance, or illustration." Any embodiment described herein as "exemplary" is not to be construed as necessarily preferred or advantageous over other embodiments. Additionally, it will be appreciated that for simplicity and/or clarity of illustration, elements illustrated in the figures have not necessarily been drawn to scale. For example, the dimensions of some of the elements may be exaggerated relative to other elements for illustrative clarity. Further, in some figures only one or two of a plurality of similar elements are indicated by reference characters for illustrative clarity of the figure, whereas less than all of the similar elements may be indicated by reference characters. Further still, it should be understood that although some portions of components and/or elements of the subject matter disclosed herein have been omitted from the figures for illustrative clarity, good design, material selection, and assembly practices are intended.

I claim:

1. A weight plate for mounting on a bar configured for use in exercising, the bar providing a cylindrical outer surface, wherein the bar includes a base adjacent the cylindrical outer surface, the weight plate comprising:

a cylindrical inner face configured for mounting on the cylindrical outer surface of the bar;

a securing mechanism arranged adjacent the inner face for selectively securing and unsecuring the weight plate relative to the bar, the securing mechanism capable of being locked in a secured condition with the weight plate secured to the bar and capable of being locked in an unsecured condition with the weight plate unsecured from the bar; and a control apparatus for the securing mechanism operable to switch the securing mechanism between the secured and unsecured conditions, the control apparatus including a trigger operable, with the securing mechanism in the unsecured condition, to switch the securing mechanism to be locked in the secured condition; and a handle operable, with the securing mechanism in the secured condition to switch the securing mechanism to be locked in the unsecured condition, further wherein the weight plate defines two sides and is configured to be mounted by sliding along the outer surface of the bar and into contact with the base, and wherein the trigger includes a pair of rings, each ring disposed on one of the two sides of the weight plate, each ring configured to switch the securing mechanism to the secured condition when the ring is pressed against the base.

2. The weight plate according to claim 1, wherein the securing mechanism includes at least one brake shoe that is movable relative to the inner face, and the brake shoe in the secured condition is in a position within the inner face and the brake shoe in the unsecured condition is in a position not within the inner face.

3. The weight plate of claim 2 further comprising two additional brake shoes, each additional brake shoe movable relative to the inner face, and each additional brake shoe in the secured condition is in the position within the inner face and each additional brake shoe in the unsecured condition is in the position outside the inner face.

4. The weight plate of claim 2 wherein the handle is coupled to the brake shoe, and the handle is operable to move the brake shoe from the position within the inner face to the position outside the inner face.

5. The weight plate of claim 4 further comprising two additional brake shoes and two additional handles, each additional brake shoe movable relative to the inner face, and each additional brake shoe in the secured condition is in the position within the inner face and each additional brake shoe in the unsecured condition is in the position outside the inner face, and each additional handle coupled to one of the additional brake shoes, and each handle is operable to move its respective brake shoe from the position within the inner face to the position outside the inner face.

6. The weight plate of claim 5 wherein each of the three handles is operable to move all three brake shoes from the position within the inner face to the position outside the inner face.

7. The weight plate of claim 1 for use with the bar that includes a base adjacent the cylindrical outer surface, the weight plate configured to be mounted, with the securing mechanism in the unsecured condition, by sliding along the outer surface of the bar and into contact with the base, and wherein the trigger includes a ring that switches the securing mechanism to the secured condition when the ring is pressed against the base.

8. The weight plate of claim 1 including a flange extending outwardly from the inner face of the weight plate, the flange providing a support for an outer disk of selectable weight.

9. A central portion for a weight plate for use in mounting on a bar configured for use in exercising, the bar providing a cylindrical outer surface, the central portion of the weight plate configured for coupling to an outer disk of selectable weight, the central portion of the weight plate comprising:

a cylindrical inner face configured for mounting on the cylindrical outer surface of the bar;

a securing mechanism arranged adjacent the inner face for selectively securing and unsecuring the central portion of the weight plate relative to the bar, the securing mechanism capable of being locked in a secured condition with the central portion of the weight plate secured to the bar and capable of being locked in an unsecured condition with the central portion of the weight plate unsecured from the bar; and a control apparatus for the securing mechanism operable to switch the securing mechanism between the secured and unsecured conditions, the control apparatus including a trigger operable, with the securing mechanism in the unsecured condition, to switch the securing mechanism to the secured condition; and a handle operable, with the securing mechanism in the secured condition to switch the securing mechanism to the unsecured condition, further wherein the central portion for the weight plate defines two sides and is configured to be mounted by sliding along the outer surface of the bar and into contact with the base, and wherein the trigger includes a pair of rings, each ring disposed on one of the two sides of the central portion for the weight plate, each ring configured to switch the securing mechanism to the secured condition when the ring is pressed against the base.

10. The central portion of the weight plate of claim 9 further comprising a flange extending outwardly from the inner face of the central portion of the weight plate, the flange providing a support for the outer disk of selectable weight.

11. A weight plate system providing a plurality of weight plates with each weight plate having a selectable total weight, and each weight plate including an automatic securing mechanism, each weight plate for use in mounting on a bar configured for use in exercising, the bar providing a cylindrical outer surface, and each weight plate comprising:

a central portion and an outer disk of selectable weight coupled to the central portion, wherein the central portion includes:

a cylindrical inner face configured for mounting on the cylindrical outer surface of the bar;

an automatic securing mechanism arranged adjacent the inner face for selectively securing and unsecuring the central portion of the weight plate relative to the bar, the automatic securing mechanism capable of being locked in a secured condition with the central portion of the weight plate secured to the bar and capable of being locked in an unsecured condition with the central portion of the weight plate unsecured from the bar; and a control apparatus for the securing mechanism operable to switch the securing mechanism between the secured and unsecured conditions, the control apparatus including a trigger operable, with the securing mechanism in the unsecured condition, to switch the securing mechanism to the secured condition; and a handle operable, with the securing mechanism in the secured condition to switch the securing mechanism to the unsecured condition, further wherein the weight plate defines two sides and is configured to be mounted by sliding along the outer surface of the bar and into contact with the base, and wherein the trigger includes a pair of rings, each ring disposed on one of the two sides of the weight plate, each ring configured to switch the securing mechanism to the secured condition when the ring is pressed against the base.

12. The weight plate system of claim 11 wherein for each weight plate the securing mechanism includes at least three clamps that are movable relative to the inner face between a position within the inner face and a position outside the inner face, and wherein movement of one of the clamps from the position within the inner face to the position outside the inner face causes movement of the other two clamps to the position outside the inner face.

* * * * *